US005171004A

United States Patent [19]

Berchtold

[11] Patent Number: 5,171,004

[45] Date of Patent: Dec. 15, 1992

[54] CLAMPING DEVICE WITH FORCE AMPLIFIER, ESPECIALLY MACHINE VISE

[75] Inventor: Heinrich Berchtold, Nänikon/Uster, Switzerland

[73] Assignee: Gressel AG, Aadorf, Switzerland

[21] Appl. No.: 706,797

[22] Filed: May 29, 1991

[30] Foreign Application Priority Data

Jun. 7, 1990 [DE] Fed. Rep. of Germany ..... 4018284

[51] Int. Cl.[5] ..... B25B 1/14

[52] U.S. Cl. ..... 269/228; 269/244

[58] Field of Search ..... 269/221, 223, 228, 240, 269/243, 244, 245, 246

[56] References Cited

U.S. PATENT DOCUMENTS

| | | | |
|---|---|---|---|
| 3,400,924 | 9/1968 | Arnold et al. | 269/228 |
| 3,650,522 | 3/1972 | Wermuth et al. | 269/244 |
| 4,046,364 | 9/1977 | Coope et al. | 269/244 |
| 5,022,636 | 6/1991 | Swann | 269/244 |

FOREIGN PATENT DOCUMENTS

| | | | |
|---|---|---|---|
| 0322917 | 7/1989 | European Pat. Off. | 269/244 |

*Primary Examiner*—J. J. Swann

*Attorney, Agent, or Firm*—Flynn, Thiel, Boutell & Tanis

[57] ABSTRACT

A machine vise with force amplifier comprises a fixed jaw (2) and a movable jaw (3) on a vise body (1, 1*a*, 1*b*), the movable jaw being adjustable by means of a threaded spindle (14). The force amplifier (9, 10, 11) is enclosed by a rotatable tightening sleeve (6), which engages by means of an external thread (7) in a female thread (8) of a housing (5) around the sleeve. Within the tightening sleeve (6) there are arranged a first tightening ring (9) fast against rotation and a second tightening ring (10) rotatable to a limited extent. A plurality of tightening pins are provided between the two tightening rings (9, 10). The stationary housing (5) is arranged in the vise body (1, 1*a*) beneath the fixed jaw (2). The second tightening ring (10) is fixedly connected to the one end (13*a*) of a pull rod (13) passing through the first tightening ring (9) and the threaded spindle (14), on the other end (13*b*) of which rod there engage an adjusting sleeve (21) and an operating lever (15). Belleville springs (23) and at least one part of the adjusting sleeve (21) are arranged within a hand-grip (25) of the threaded spindle (14) and bear on the bottom (25*a*) of the hand-grip (25) with interposition of a thrust bearing (24).

14 Claims, 2 Drawing Sheets

CLAMPING DEVICE WITH FORCE AMPLIFIER, ESPECIALLY MACHINE VISE

Figure 1:
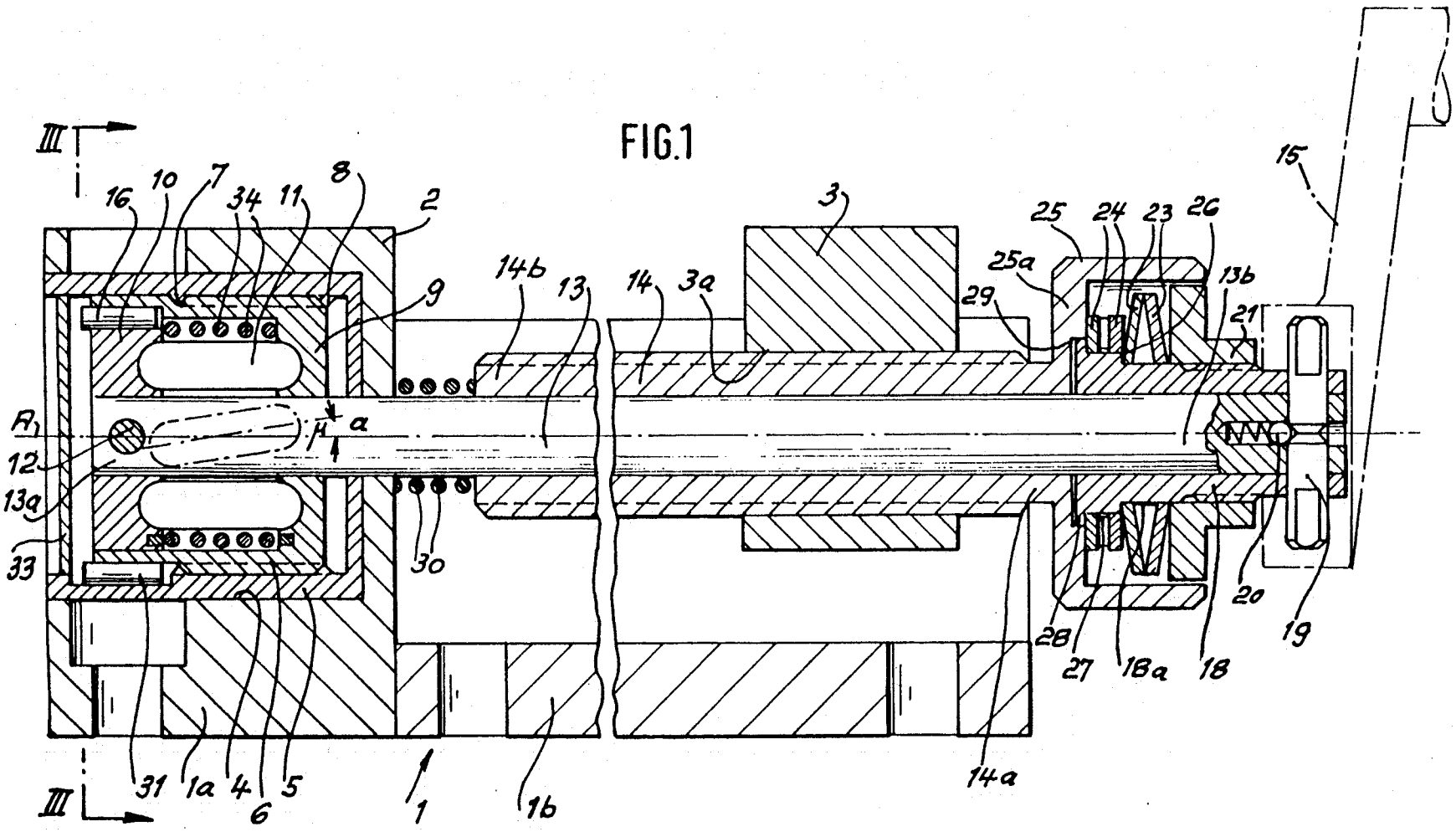

This invention relates to a clamping device with force amplifier especially machine vise, with a clamping device body, a fixed jaw arranged thereon and a jaw movable relative thereto, for the adjustment of which there is provided a rod acted upon by the force amplifier, with a rotatable tightening sleeve surrounding the force amplifier and having an external thread, engaging thereby in a female thread of a stationary housing surrounding the tightening sleeve, the rotational movement of which is delimited relative to the housing by stop surfaces, with a first tightening ring arranged fast against rotation in the tightening sleeve, with a second tightening ring arranged for limited rotation in the tightening sleeve and rotatable by means of an operating lever for the force amplifier, with a plurality of tightening pins arranged between the tightening rings, which pins are arranged in one end position (open position) of the second tightening ring at an acute angle to the tightening sleeve axis and in the other end position (clamping position) of the second tightening ring, approximately parallel to the tightening sleeve axis, with a compression spring acting on the second tightening ring in the direction of the first tightening ring and with a thrust bearing as well as a plurality of Belleville springs arranged in the region of the hand-grip, the pre-tension of which springs can be adjusted by an adjusting sleeve, and which springs can be further tightened by means of the force amplifier and act on the rod in the clamping position of the second tightening ring.

In a clamping device of this kind (DE 3 729 093 C1) the stationary housing surrounding the tightening sleeve is arranged axially outside a stationary part of the clamping device. The tightening sleeve and approximately half the force amplifier project axially out of the housing. Adjoining thereon are further in the axial direction the Belleville springs and the adjusting sleeve, which is for its part adapted to screw on the tightening sleeve. There projects further from the tightening sleeve also the hand-grip of the threaded spindle. In all the total structural length of the device relative to its maximum gripping width is really large on account of the axial stacking of the said components adjoining a stationary part of the device body. The parts of the drive and the force amplifier projecting relatively far beyond the device body are also subject to the risk of damage. Finally the movable jaw is pressed on to the workpiece by a pressure rod adjustable in the hollow threaded spindle. Through the clamping forces created thereby there result outwardly directed forces opposed to one another on the fixed jaw and the stationary part of the device body, which can lead to upward bowing of the device body in its middle part. The latter has the result that the jaws no longer run accurately parallel to one another, but have a greater spacing in the upper region than in the lower. Because of this the workpiece is only clamped in the lower region of the jaws. The above-described known clamping device nevertheless has the advantage that, thanks to the tightening sleeve adapted to be screwed and the force amplifier arranged therein, an opening and tightening stroke of the movable jaw of approximately 2–4 mm, and thus a so-called rapid clamping with force amplification, is possible with a relatively small overall angle of rotation of the operating lever of less than 180°.

In contrast to this the invention is based on the problem of providing a clamping device with force amplifier of the kind initially cited, especially a machine vise, maintaining the rapid clamping, in which the ratio of the maximum gripping width to the total structural length is optimally large, deformations of the device body through the clamping forces also being avoided as far as possible.

This is achieved according to the invention in that the stationary housing is arranged in the clamping device body beneath the fixed jaw or is formed in the region located beneath the fixed jaw, in that the second tightening ring is fixedly connected to the one end of a pull rod extending through the first tightening ring and the movable jaw, to the other end of which rod, extending out of the movable jaw , the tightening sleeve is connected and the operating lever can be connected, and in that the Belleville springs are arranged and bear with the interposition of the thrust bearing on the side of the movable jaw facing away from the fixed jaw.

Through the arrangement of the stationary housing, the tightening sleeve and the force amplifier in the region below the fixed jaw, an especially short construction of the clamping device is achieved, since all components essential for the generation of the high pressure clamping are integrated in other components of the device determining the overall structural length of the clamping device. The ratio of the maximum gripping width to the total structural length is therefore optimally large. The sensitive parts of the clamping device, such as tightening sleeve and the force amplifier itself are protected in the region below the fixed jaw. In addition, the Belleville springs, the thrust bearing and the adjusting sleeve can also be arranged if desired protected inside a hollow hand-grip of a threaded spindle. Danger of damage is thus largely eliminated. In the new clamping device the pull rod has a dual function. It serves on the one hand to drive the tightening sleeve and the force amplifier and, on the other hand, it transfers the clamping force from the force amplifier arranged at one end of the clamping device to the adjusting sleeve arranged at the other end, and through the Belleville springs abutting thereon, the thrust bearing and if desired a threaded spindle to the movable jaw. By means of the pull rod the clamping force when gripping a workpiece is transferred directly to the movable jaw as a tensile force, so that the device body itself is largely relieved from clamping forces and deformation of the same, as well as the associated disadvantages, cannot arise.

From DE-GM 87 17051 there is known a machine vise with drive through a threaded spindle, in which the clamping force when gripping a workpiece is transferred directly to the movable jaw by means of the threaded spindle by virtue of the arrangement of the spindle counter-bearing in the region below the fixed jaw and of the spindle nut on a slider carrying the movable jaw, so that the vise body itself remains largely relieved from clamping forces and deformations of the vise body, as well as the associated disadvantages, cannot arise. However, in this vise, the tightening is effected by rotation of a completely conventional threaded spindle, without rapid tightening with a small total angle of rotation with force amplification being possible.

The sub-claims represent further advantageous developments of the protected invention.

Figure 2:
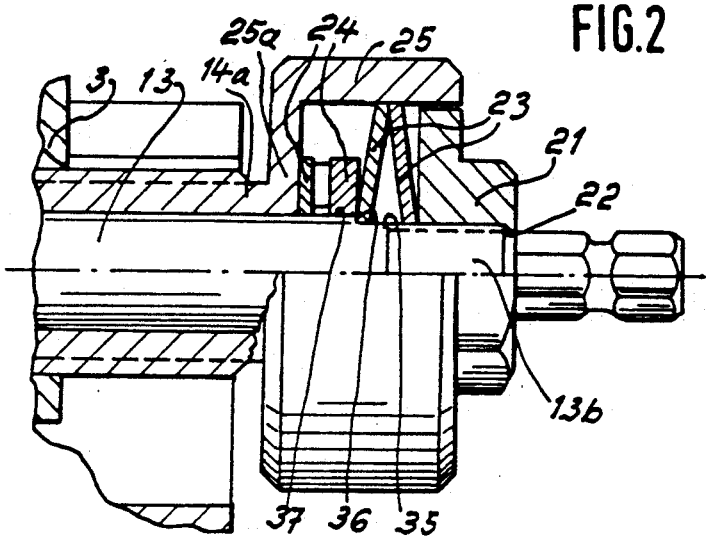
Figure 3:
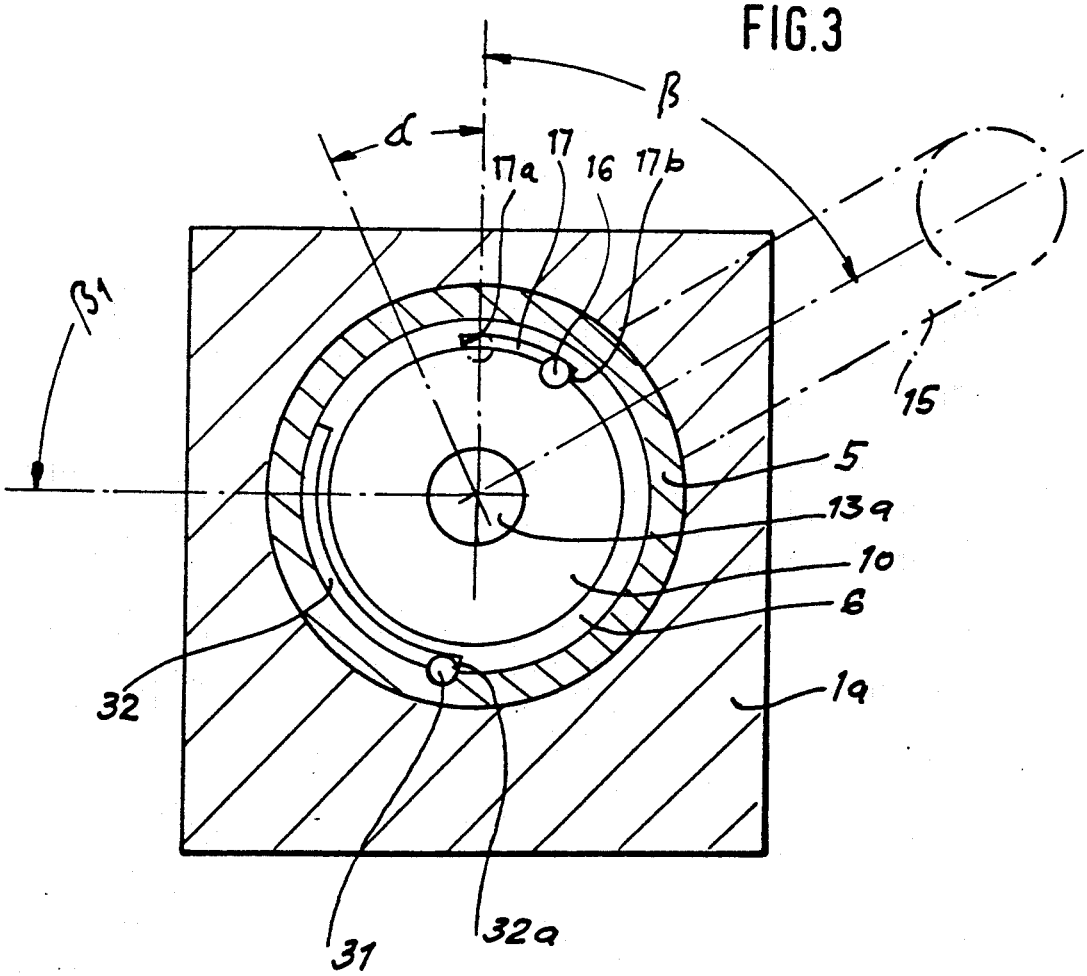

The invention is explained in more detail below, with the aid of embodiments shown in the drawings these show:

FIG. 1 is a longitudinal section of a first embodiment in the form of a machine vise, FIG. 2 a partial section of a second embodiment, likewise in the form of a machine vise, FIG. 3 a transverse section according to the line III—III of FIG. 1.

The vise body 1 consists in the illustrated embodiment of a head part 1*a*, which is screwed fast to a guide part 1*b*. Head part and guide part can however be made in one piece. The head part 1*a* carries in its upper region a fixed jaw 2, which can be removable from the head part in known manner. In the guide part 1*b* there is slidably mounted on longitudinal guides, not shown, the movable jaw 3. Here also the movable jaw can be detachable from a slider carrying the same, which is not shown in the drawing however for the sake of simplicity. In the head part 1*a* of the vise body there is arranged below the fixed jaw 2, in a suitable recess 4, a housing 5, rotationally and axially fast, i.e. rigid with the head part 1*a*. The housing 5 could, if desired, also be in one piece with the head part 1*a*. In the housing 5 a tightening sleeve 6 is mounted for limited rotation. The tightening sleeve 6 has an external thread 7 which engages in a corresponding female thread 8 of the housing 5. The two threads 7, 8 are advantageously formed as coarse threads (steep threads). In the illustrated embodiment the external thread 7 is a trapezoidal thread Tr50×10(mm), i.e. it has a thread pitch or lead of 10 mm with a nominal diameter of 50 mm. Since the pitch of the external thread 7 is crucial to the feed or opening stroke which can be attained with a predetermined angle of rotation of an operating lever described below, and since the external thread 7 must always be self-locking, the pitch cannot be increased arbitrarily. For this reason it is advantageous if the external thread has a nominal diameter of at least 44 mm with a pitch of 8 mm.

A first tightening ring 9 is arranged within the tightening sleeve 6 and is connected fast to the tightening sleeve. The first tightening ring 9 and the tightening sleeve 6 can also consist of one part, as is shown. The tightening ring 9 forms a first part of a force amplifier enclosed by the tightening sleeve 6. A second tightening ring 10 is arranged in the tightening sleeve 6, spaced from the first tightening ring 9 and capable of limited rotation and axial displacement. Between the two tightening rings 9, 10 there are provided a total of three tightening pins 11 offset from one another by 120° in the circumferential direction. The tightening pins 11 assume an acute angle $\mu$ of e.g. 10° relative to the axis A of the tightening sleeve 6 in the one end position of the second tightening ring 10 which corresponds to the relieved, open position of the machine vise, as is indicated in FIG. 1 by chain-dotted lines.

The one end 13*a* of a pull rod 13 is firmly connected to the tightening ring 10 by a transverse pin 12, the rod passing through the other tightening ring 9 and a hollow threaded spindle 14 and extending at its other end 13*b* out of the threaded spindle 14. The operating lever 15 shown in chain dotted lines can be fitted on this other end 13*b* of the pull rod 13, with which handle the pull rod and thus also the second tightening ring 10 can be turned. A stop pin 16 is arranged in a semi-circular recess of the second tightening ring 10. The tightening sleeve 6 comprises a first recess 17, whose end surfaces 17*a* and 17*b* form stop surfaces for the stop pin 16. In the one end position of the tightening ring 10, which corresponds to the relieved, open position of the machine vise, the stop pin 16 bears on the stop surface 17*b*. The other end position of the second tightening ring 10 is determined by the stop surface 17*a*, on which the stop pin 16 bears in the clamped position of the machine vise. On turning the second tightening ring 10 out of the open position into the clamped position, the ends of the tightening pins 11 engaging in the tightening ring 10 are entrained, so that the angle $\mu$ between the tightening pin axes a and the tightening sleeve axis A is reduced and becomes 0° shortly before reaching the clamped position. The stop surface 17*a* is so arranged that the tightening pins 11 are already moved slightly beyond their parallel position relative to the tightening sleeve axis A in the clamped position of the tightening ring 10, i.e. beyond their dead-point position, whereby a secure locking of the force amplifier is achieved.

On the end 13*b* of the pull rod 13 projecting out of the threaded spindle is arranged a bush 18, which is connected axially and rotationally fast to the end 13*b* by means of a transverse pin 19. The transverse pin 19 transfixes the bush 18 and the pull rod end 13*b* and is retained by a spring-loaded detent ball 20. In this manner the bush 18 can easily be released when necessary by withdrawing the transverse pin 19 from the pull rod 13. In addition the operating lever 15 engages with the transverse pin. An adjusting sleeve 21 is axially adjustable on the bush 18 by means of a fine thread 22. The pre-stressed force of a plurality of Belleville springs 23 can be adjusted with this adjusting sleeve 21. The Belleville springs 23 act in the clamped position through a thrust bearing 24 on the bottom 25*a* of a hollow hand-grip 25. The bottom 25*a* is connected to the end 14*a* of the threaded spindle 14 opposite the fixed jaw 2. The hollow hand-grip encloses the thrust bearing 24, the Belleville springs 23 and a part of the adjusting sleeve 21. The spindle 14 can be turned by means of the hand-grip 25 and the movable jaw 3 thereby be adjusted relative to the fixed jaw 2. By turning the adjusting sleeve 21 relative to the bush 18, the force of the Belleville spring pack 23 can be adjusted, and with it the clamping force obtainable with the machine vise.

Since the pre-tension force created by the Belleville springs 23 is relatively large, it would hinder rotation of the threaded spindle 14 for the coarse adjustment of the jaw 3, in spite of the thrust bearing 24. For this reason the bush 18 has an annular shoulder 26 adjoining its part 18*a* carrying the Belleville springs, adjoined in turn by a step 27, on which the thrust bearing 24 is arranged. The diameter of the step 27 is greater than that of the part 18*a* carrying the Belleville springs. Adjoining the step 27 there is provided a flange 28, which is axially displaceable in a recess of the bottom 25*a*. The axial spacing between the annular shoulder 26 and the flange 28 is equal to or somewhat greater than the axial width of the thrust bearing 24. In this manner, in the relieved position of the machine vise, the Belleville springs 23 do not bear on the thrust bearing 24, or only with very small force, and so do not hinder rotation of the threaded spindle 14 in any way. Between the end 14*b* of the threaded spindle 14 facing the fixed jaw 2 and the head part 1*a* of the vise body 1 there is arranged a compression spring 30, which surrounds the pull rod 13 concentrically. This compression spring 30 urges the hollow spindle 14 to the right in the open position of the machine vise and also ensures that the tightening pins 11 stay in their inclined position relative to the tightening sleeve axis A during the feed stroke.

In order that the operating lever 15 shall always move within a predetermined angular range on tightening and opening the machine vise, which is of especial importance for rapid clamping, the rotational movement of the tightening sleeve 6 relative to the housing 5 in the opening direction is limited by a second stop pin 31 and a stop surface 32*a* cooperating therewith, which is an end surface of a recess 32 provided in the tightening sleeve 6. The stop pin 31 is fixed in a semi-circular recess of the housing 5. An addition torsion spring 34 between the two tightening rings 9, 10 ensures, together with the stop pins 16, 31 and the stop surfaces 17*b* and 32*a* that there is a defined starting position of the operating lever before each clamping operation.

The housing 5 is tightly closed by means of a cover 33 and filled with oil or grease, so that the parts of the clamping device and the force amplifier contained therein are not vulnerable and are long-lived, even with extremely high operating demands.

The mode of operation is as follows:

For the coarse adjustment of the gripping width of the machine vise the hollow spindle 14 is turned by means of the hand-grip 25. Through its thread engaging in the spindle nut 3*a* of the movable jaw 3 the movable jaw is displaced. The gripping width of the machine vise can thus be adjusted steplessly. In practice the gripping width is adjusted to about 2 mm more than the dimension of the workpiece to be gripped, so that this can be placed in the machine vise without hindrance.

The tightening and releasing (rapid clamping) of the workpiece are then effected by means of the separate operating lever 15. In the open position of the machine vise the tightening sleeve is turned according to FIG. 3 so far to the right that the stop surface 32*a* bears on the stop pin 31. Moreover the second tightening ring 10 is turned so far to the right that the stop pin 16 bears on the stop surface 17*b*. The operating lever assumes the position shown chain-dotted in FIG. 3. By swinging the operating lever 15 to the left according to FIG. 3, in the anti-clockwise sense, the pull rod 13 and with it the second tightening ring 10 also are turned. Under the action of the compression spring 30 as well as of the torsion spring 34, the tightening pins 11 initially stay in their position inclined relative to the tightening sleeve axis A. In the initial rotation of the second tightening ring 10 the first tightening ring 9 is thus drawn along in the same direction of rotation. Since this is rotationally fast with the tightening sleeve 6, the tightening sleeve 6 also is initially turned in the same direction of rotation. Through the cooperation of the external thread 7 with the female thread 8, the tightening sleeve 6 moves to the left according to FIG. 1. The second tightening ring 10 is also moved to the left through the first tightening ring 9 and the tightening pins 11 and carries with it, through the pull rod 13, the bush 18, the Belleville springs 23, the thrust bearing 24 and the bottom 25*a*, the threaded spindle 14, which, for its part, moves the movable jaw 3 into abutment with the workpiece. The path which the movable jaw 3 covers from its open position up to abutment with the workpiece is denoted the feed stroke. If this feed stroke amounts to 2 mm for example, the operating lever 15 must be swung through an angle $\beta$ of 72° according to FIG. 3.

As soon as the jaw 3 bears on the workpiece the torque increases and further rotation of the tightening sleeve 6 is blocked by the threads 7, 8. Accordingly the first tightening ring 9 also cannot turn further. The actual tightening stroke now follows. With further rotation of the second tightening ring 10 to the left according to FIG. 3, the tightening pins 11 are righted, i.e. the angle $\mu$ relative to the tightening sleeve axis A decreases. Through this righting of tightening pins 11 the distance between the two tightening rings 9, 10 increases. The rotation of the second tightening ring 10 continues until the axes a of the tightening pins 11 are inclined beyond their dead-point position running parallel to the tightening sleeve axis A by about 3° in the opposite sense to their starting position relative to the tightening sleeve axis A. In this clamping position the stop pin 16 lies on the stop surface 17*a* of the tightening sleeve 6. A stable clamping position is thereby obtained. Through the increase in the spacing between the two tightening rings 9, 10 during the tightening stroke of around 0.44 mm, the second tightening ring 10 is displaced somewhat further to the left and thereby shifts the pull rod 13 also by the same amount to the left. Through this the Belleville springs 23 press with their pre-set clamping force via the thrust bearing 24 on the bottom 25*a* and thus on the threaded spindle 14. This thus presses the movable jaw 3 with the pre-set clamping force on the workpiece. With possible yielding of the workpiece the clamping force is maintained, thanks to the elasticity of the Belleville springs 23, even if it falls off slightly.

The releasing takes place in the opposite sequence, in that the operating lever 15 is swung in the opposite direction, to the right according to FIG. 3. Through this the second tightening ring 10 also turns to the right, until the stop pin 16 comes into abutment with the stop surface 17*b*, whereby it is ensured that the tightening pins 11 are not tilted beyond the predetermined inclined position of 10° relative to the tightening sleeve axis A. The compression spring 30 holds the second tightening ring 10 constantly in abutment with the tightening pins 11 and moreover has the effect that the threaded spindle 14 is moved to the right into the open position. As soon as the stop pin 16 bears on the stop surface 17*b*, the tightening sleeve 6 is turned clockwise according to FIG. 3, until its stop surface 32*a* comes to bear on the stop pin 31. The operating lever 15 thus again assumes its position shown in chain dotted lines in FIG. 3. Through the rotation of the tightening sleeve 6 relative to the housing 5, the tightening sleeve moves to the right according to FIG. 1 and the threaded spindle 14 can follow it under the action of the compression spring 30. The movable jaw 3 is thus moved fully into its open position.

In the embodiment shown in FIG. 1, the bush 18 can be released from the pull rod 13 by pulling out the transverse pin 19, without the pre-tension of the Belleville springs 23 set by means of the adjusting sleeve 21 being affected. After releasing the bush 18 the threaded spindle 14 can be withdrawn from the guide part 1*b*, together with the movable jaw 3, for cleaning and other purposes, for example also for fixing the vise.

The embodiment shown in FIG. 2 differs only in the connection of the adjusting sleeve 21 to the pull rod 13. The same reference numerals as in FIG. 1 are used for parts with like function in FIG. 2, so that repeated description of these is superfluous. In the embodiment shown in FIG. 2 the adjusting sleeve 21, the Belleville springs 23 and the thrust bearing 24 are arranged directly on the end 13*b* of the pull rod 13. The adjusting sleeve 21 is adjustable relative to the pull rod 13 by means of a fine thread 22. The pull rod has an annular shoulder 36 adjoining its part 35 carrying the Belleville springs 23, on which shoulder the Belleville springs abut, so long as the force amplifier is not brought out of its open position into its clamping position. Adjoining the annular shoulder 36 the pull rod 13 has a section of larger diameter than the supporting part 35, on which the thrust bearing 24 is arranged. The axial spacing of the annular shoulder 36 from the bottom 25*a* with the force amplifier relieved is equal to or somewhat greater than the axial width of the thrust bearing. Through this, as in the previously described embodiment, there results that the strong spring force of the Belleville springs 23 is decoupled from the thrust bearing 23, so that the threaded spindle 14 can be turned easily by means of the hand-grip 25 for the coarse adjustment of the jaw 3.

If the clamping device is conceived within the meaning of claim 1 as a clamping device with a predetermined clamping width, then the hollow threaded spindle 14 is done away with. In this case the bush 18 bears directly on the movable jaw 3 with its flange 28.

In rapid clamping of workpieces the angle of rotation $\beta 1$ of the operating lever 15 should be less than 200°, preferably less than 150°. This is ensured in the machine vise according to the invention. With an angle of rotation $\beta$ of 144° a feed stroke of 4 mm can in fact be obtained. To this angle of rotation $\beta$ there is added the angle $\alpha$ of 22°, which is needed for carrying out the tightening stroke.

I claim:

1. In a clamping device with force amplifier with a clamping device body, a fixed jaw arranged thereon and a jaw movable relative thereto, for the adjustment of which there is provided a rod acted upon by the force amplifier, with a rotatable tightening sleeve surrounding the force amplifier and having an external thread, engaging thereby in a female thread of a stationary housing surrounding the tightening sleeve, the rotational movement of which is delimited relative to the housing by stop surfaces, with a first tightening ring arranged fast against rotation in the tightening sleeve, with a second tightening ring arranged for limited rotation in the tightening sleeve and rotatable by means of an operating lever attached to said rod, with a plurality of tightening pins arranged between the tightening rings, which pins are arranged in one end position (open position) of the second tightening ring at an acute angle to the tightening sleeve axis and in the other end position (clamping position) of the second tightening ring, approximately parallel to the tightening sleeve axis, with a compression spring acting between the first and second tightening rings, the improvement wherein said clamping device includes a thrust bearing as well as a plurality of Belleville springs mounted on said rod proximate a hand grip, the pre-tension of said Belleville springs can be adjusted by an adjusting sleeve and further tightened by means of the force amplifier to act on the rod when in the clamping position of the second tightening ring, wherein the stationary housing is arranged in the clamping device body beneath the fixed jaw, and wherein the second tightening ring is fixedly connected to a first end of said rod extending through said tightening ring and the movable jaw to a second end of said rod which is connected to said adjusting sleeve and the operating lever, wherein said Belleville springs are arranged and bear with interposition of said thrust bearing on a side of the movable jaw facing away from the fixed jaw, and wherein said rod is surrounded by a hollow threaded spindle, rotatable by means of said hand grip, wherein said spindle can screw into the movable jaw to move said movable jaw.

2. The clamping device according to claim 1, wherein the Belleville springs and at least a part of the adjusting sleeve are arranged in the hand grip and bear, with the interposition of the thrust bearing, on a surface of the hand-grip connected to the thread of spindle.

3. The clamping device according to claim 1 wherein the adjusting sleeve, the Belleville springs and the thrust bearing are arranged on a bush connected axially fast to the pull rod, and in that the adjusting sleeve is axially adjustable relative to the bush through a fine thread.

4. The clamping device according to claim 3, wherein the bush is releasably connected to the pull rod by means of a transverse pin passing through the pull rod.

5. The clamping device according to claim 3, wherein the bush comprises an annular shoulder supporting the Belleville springs, on which shoulder the Belleville springs bear, and a step, on which step the thrust bearing is arranged, and in that there is provided, adjoining the step, a flange which is displaceable in a recess in said hand-grip, where axial spacing between annular shoulder and flange is the same as or somewhat larger than an axial width of the thrust bearing.

6. The clamping device according to claim 1, wherein the adjusting sleeve, the Belleville springs and the thrust bearing are arranged on the pull rod itself and in that the adjusting sleeve is adjustable relative to the pull rod by means of a fine thread.

7. The clamping device according to claim 6, wherein the pull rod comprises an annular shoulder supporting the Belleville springs, on which shoulder the Belleville springs bear, and a section, on which section the thrust bearing is arranged, where the axial spacing of annular shoulder from the bottom of the hand-grip is the same as or somewhat larger than an axial width of the thrust bearing with force amplifier relieved.

8. The clamping device according to claim 2, wherein the compression spring embraces the pull rod and is arranged, between an end of the threaded spindle and the fixed jaw.

9. The clamping device according to claim 1, wherein the external thread on the tightening sleeve is a coarse thread.

10. The clamping device according to claim 9, wherein the external thread on said tightening sleeve has a nominal diameter of at least 44 mm with a pitch (lead) of at least 8 mm.

11. The clamping device according to claim 10, wherein the external thread on said tightening sleeve is a trapezoidal thread Tr50×10(mm).

12. The clamping device according to claim 1, wherein an angle of rotation ($\alpha$) of the second tightening ring relative to the tightening sleeve is so limited by stops that the tightening pins in the clamping position of the second tightening ring are always moved slightly beyond their parallel disposition (dead-point position) to the tightening sleeve axis (A).

13. The clamping device according to claim 12, wherein an angle of rotation ($\alpha$) of the second tightening ring relative to the tightening sleeve is less than 25°.

14. The clamping device according to claim 1, wherein a maximum angle of rotation of the operating lever relative to the housing is smaller than about 150°.

* * * * *

UNITED STATES PATENT AND TRADEMARK OFFICE

CERTIFICATE OF CORRECTION

PATENT NO. : 5 171 004

DATED : December 15, 1992

INVENTOR(S) : Heinrich BERCHTOLD

It is certified that error appears in the above-identified patent and that said Letters Patent is hereby corrected as shown below:

Column 8, line 9; change "thread of" to ---threaded---.

Column 8, line 10; after "claim 1" insert ---,---.

Column 8, line 36; delete "the".

Column 8, line 39; after "with" insert ---the---.

Column 8, line 42; delete ",".

Signed and Sealed this

Twenty-third Day of November, 1993

*Attest:*

Bruce Lehman

BRUCE LEHMAN

*Attesting Officer*

*Commissioner of Patents and Trademarks*